United States Patent [19]

Krumlinde

[11] 4,018,000

[45] Apr. 19, 1977

[54] BURNER UNIT ESPECIALLY FOR TOY STEAM ENGINES

[75] Inventor: Jockum Krumlinde, Vittsjo, Sweden

[73] Assignee: Aktiebolaget Alga, Vittsjo, Sweden

[22] Filed: Nov. 21, 1975

[21] Appl. No.: 634,199

[30] Foreign Application Priority Data

Dec. 6, 1974 Sweden ..... 7415337

[52] U.S. Cl. ..... 46/1 R

[51] Int. Cl.[2] ..... A63H 19/06

[58] Field of Search ..... 46/1 R, 39

[56] References Cited

UNITED STATES PATENTS

| | | | |
|---|---|---|---|
| 1,480,445 | 1/1924 | Horlacher et al. | 46/39 |
| 1,604,187 | 10/1926 | Miller | 46/39 |

*Primary Examiner*—Louis G. Mancene
*Assistant Examiner*—Robert F. Cutting
*Attorney, Agent, or Firm*—Ostrolenk, Faber, Gerb & Soffen

[57] ABSTRACT

A burner unit for toy steam engines. The combustible matter for firing the engine is received in a receptacle mounted upon a reciprocally slidable angle arm. Locking means automatically locks the angle arm against movement when the combustible matter is placed in the fully inserted position. The releasable locking means prevents the burner unit from being accidentally withdrawn and also makes it rather difficult for youngsters to move or withdraw the burner unit and thereby provides an important safety feature.

7 Claims, 4 Drawing Figures

BURNER UNIT ESPECIALLY FOR TOY STEAM ENGINES

BACKGROUND OF THE INVENTION

This invention relates to a burner unti especially for toy steam engines and including a receptacle for combustible matter displaceable inwardly to and outwardly from a space below the bottom of the boiler.

Known burner units of different types for toy steam engines usually comprise a separate receptacle provided with a handle for positioning the conbustible matter, which is required for the operation of the boiler. When this matter has been fully consumed or when it is desired (for any reason) to terminate the fire under the boiler, one has had to lift or pull out the receptacle by aid of the handle, which handle in most cases is very hot after a few minutes of firing, and for that reason the operator can be burned if he fails to exercise proper care. It can also happen that the person operating the steam engine turns over the receptacle or drops it on to the floor owing to the heat, which can create a serious fire hazard.

BRIEF DESCRIPTION OF THE INVENTION

The present invention provides a burner unit for toy steam engines of the type described above by which the mentioned disadvantages are overcome and by which a person does not have to be in direct contact with the receptacle for the combustible matter to remove it from the boiler. According to the present invention there is provided a burner unit comprising a receptacle which is formed as a unit belonging to the base plate of the steam engine, said unit being displaceable inwardly to and outwardly from the region below the boiler by a control arm projecting from one end of the base plate, a section of said arm extending below the base plate and up through a slot in the base plate up to a slide, which arm is slidable along and guided in the slot, and said slide supports the receptacle at a distance from said base plate and is provided to be locked automatically in its fully entered (i.e. fully operative position beneath the boiler by a locking device, said receptacle being removable from the space below the boiler only after proper release of the locking device.

The present invention provides a burner unit which in a remarkable way fulfills the object, but is at the same time still simple and inexpensive to manufactue. When children are playing with steam engines it often occurs that smaller brothers and sisters become very curious, especially about the flame under the boiler. As the new receptacle (due to its novel design) cannot be drawn out from the space below the boiler with great ease, they cannot come in contact with said receptacle, which from an accident point of view, otherwise is very dangerous.

BRIEF DESCRIPTION OF THE FIGURES

The invention will now be described by way of example only with particular reference to the accompanying drawings wherein.

DETAILED DESCRIPTION OF THE INVENTION

Figure 1:
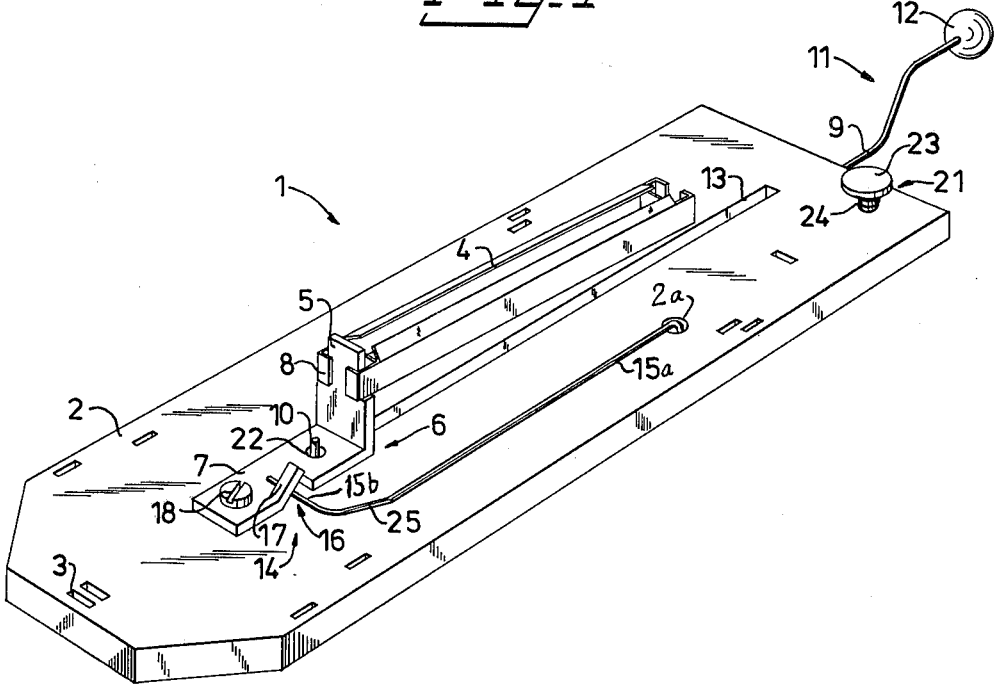
FIG. 1 is a perspective view of a burner unit of the invention.
Figure 2:
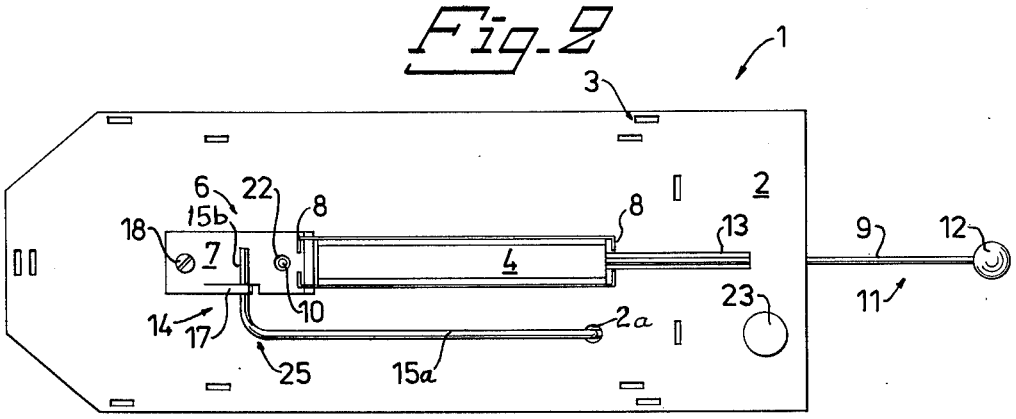
FIG. 2 is a top plan view of the burner unit of FIG. 1.
Figure 3:
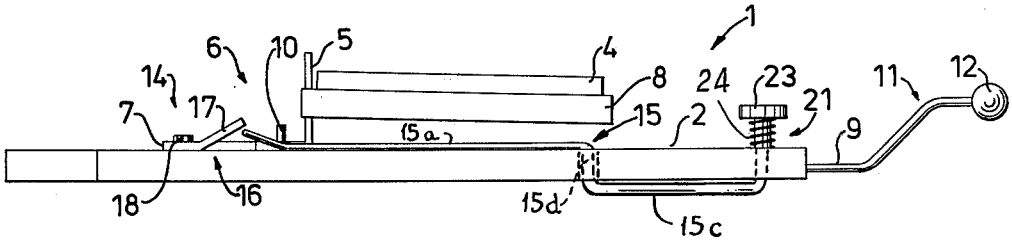
FIG. 3 is a side elevational view of the burner unit of FIG. 1.
Figure 4:
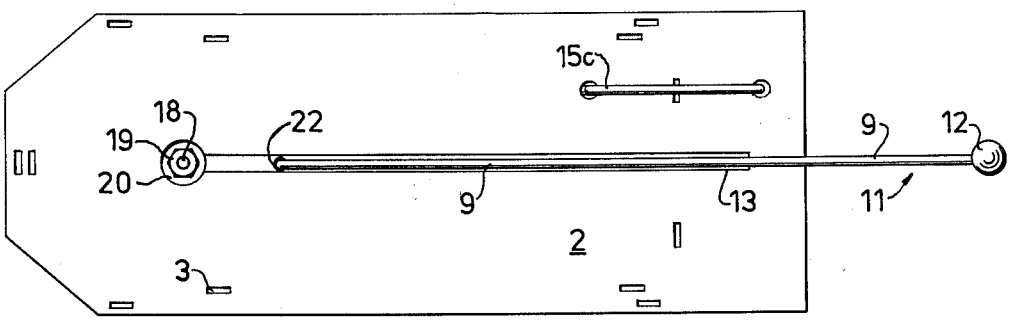
FIG. 4 is a plan view of the underside of the burner unit illustrated in FIG. 1.

The Figures show a burner unit 1 comprising a base plae 2 for supporting a steam engine, which is intended to be fastened in slots 3 provided in the base plate 2. A receptacle 4 for receiving a combustible material is supported by one arm 5 of an L-shaped member forming a slide 6, the other arm 7 of which rests against the base plate 2.

The receptacle 4 consists of an elongated U-shaped tray, the ends of which comprise a pair of inwardly directed flange means 8, which fit over and grasp a narrower section of the arm 5, so that the receptacle 4 can be vertically adjusted. The slide 6 is movable along base plate 2 by a control arm 9 having one end 10 fastened to the arm 7 of the slide 6 and the other end 11 projecting through one end of the base plate 2 and provided with a handle knob 12. The end 10 is bent upwardly and is movable along a slot 13 in the base plate 2 and extends through a hole 22 in arm 7. Slide 6 is provided to be automatically locked in its fully pushed in position on base plate 2. This is attained by aid of a locking device 14, which in the embodiment illustrated consists of a spring loaded arm 15 having a free end 15a which, in its locking position, engages a locking means 16 formed on the slide 6. Locking means 16 consists of a tongue 17 bent diagonally upward in a direction towards arm 5, said tongue 17 being a part of arm 7. A screw 18, a washer 20 and a nut 19 are mounted to the free end of arm 7, said screw 18 extending through arm 7 and the slot 13 in holding and guiding the slide 6 along slot 13.

Portions **15*a* and 15*c* of the spring loaded arm 15 are substantially parallel with and in close proximity to slot 13. Portion 15*a* has a bend 25 which positions free end 15*b* over the arm 7 of the slide 6 for cooperating with the tongue 17. The front or outer end part 15*c* of the arm 15 has a length corresponding to one third of the whole length of the arm under the base plate 2 and its vertically aligned end 21 extends through the base plate 2. Portion 15*d* extends through a bore 2*a* in base plate 2, which bore serves as a pivot about which the arm 15 may be swung. Preferably the base plate may be fitted with legs to provide sufficient clearance for the swinging movement of arm portion 15*c* so as to enable end 15*b* to be swung clear of tongue 17. The end 21 is bent in angle and provided with a manually depressible button 23, which is biased in an upward direction by helical spring 14, and therefore the arm portion 15*a* rests against the base plate 2 in its rest or normal position and the end part 15*b* is in an engagement position for locking of the slide 6.**

For drawing out the receptacle 4 from its position under the boiler the button 23 has to be pushed down in releasing in the locking device 14, causing the arm to swing about bore **2*a* so that the free end 15*a* of arm 15 is lifted up and away from the tongue 17, allowing the slide 6 to freely pass under the locking device 14. In pushing in the receptacle 4 from its drawn out or outer position the slide 6 supporting the receptacle 4 is automatically locked in its pushed in or inner position since the end part 15*a* of arm 15, after sliding upward and along the tongue 17, is snapped down under the force of spring 24 as the end 15*a* clears tongue 17 so that a drawing out of the receptacle 4 is effectively prevented without having first released the locking device 14** to thereby prevent accidental removal of the burner unit.

Although there has been described a preferred embodiment of this novel invention, many variations and modifications will now be apparent to those skilled in the art. Therefore, this invention is to be limited, not by the specific disclosure herein, but only by the appending claims.

What is claimed is:

1. A burner unit adapted for use with toy steam engines and the like comprising:

a base plate having an elongated slot;

an operating assembly comprising a slidable lever disposed along said slot and having an actuating end extending through said slot and an actuatable handle extending beyond one end of the base plate;

slide means icluding a slide member movable along the base plate and having one end thereof affixed to said lever actuating end;

said slide means including means extending into said slot and displaced from and cooperating with said lever actuating end for maintaining alignment of said slide with said slot;

said slide means further having a receptacle mounted upon said slide member and movable therewith whereby said slide member and hence said receptacle are reciprocally movable between end positions substantially coinciding with the ends of said slot;

spring biased locking means normally engageable with said slide means when said slide means is in one of said end positions to prevent movement of said slide means towards the remaining end position;

said locking means including manually operable means movable against the biasing force to displace said locking means from said slide means to realease and thereby permit movement of said slide means.

2. A burner unit according to claim 1, characterized in that said locking device comprises a spring loaded arm, which in its locking position has a free end engaging a locking means formed on said slide means.

3. A burner unit according to claim 1, characterized in that the slide member for supporting said receptacle comprises an L-shaped member having one arm resting against the base plate and the other arm directed away from the base plate and having an upper section of reduced dimensions; said receptacle having means for adjustably mounting the receptacle to the slide member.

4. A burner unit according to claim 3, characterized in that the receptacle comprises a pair of hook-shaped means at the ends of the receptacle for adjustably supporting the receptacle upon the slide member.

5. The assembly of claim 1, wherein said slide member is provided with an integral tongue member;

the free end of said arm being positioned between said tongue and said base plate when in the locked position.

6. The assembly of claim 5, wherein said base plate is provided with a bore; said locking means having an intermediate portion extending through said bore;

said bore serving as a pivot means whereby operation of said depressible means causes said locking means to swing away from said tongue to unlock said slide means.

7. The assembly of claim 6, wherein said locking means spring bias comprises a spring mounted between said depressible means and said base plate to bias said locking means towards the locked position.

* * * * *